United States Patent [19]

Paul

[11] Patent Number: 4,662,576

[45] Date of Patent: May 5, 1987

[54] ROLL HOLDER

[76] Inventor: Stanley M. Paul, 8 Anchor Dr., Rye, N.Y. 10580

[21] Appl. No.: 818,557

[22] Filed: Jan. 13, 1986

[51] Int. Cl.[4] ..... B65H 16/06

[52] U.S. Cl. ..... 242/55.2

[58] Field of Search ..... 242/55.2, 55.3, 55.53, 242/68.4, 129.51

[56] References Cited

U.S. PATENT DOCUMENTS

| | | | |
|---|---|---|---|
| 2,555,885 | 6/1951 | Hope | 242/55.53 |
| 3,847,365 | 11/1974 | Carol | 242/55.2 |
| 3,878,998 | 4/1975 | Lazzari | 242/55.2 |
| 4,043,519 | 8/1977 | Suzuki | 242/55.53 |
| 4,452,403 | 6/1984 | Arronte | 242/68.4 X |
| 4,553,710 | 11/1985 | Pool | 242/55.53 X |

*Primary Examiner*—John M. Jillions

*Attorney, Agent, or Firm*—Darby & Darby

[57] ABSTRACT

A holder for use in dispensing sheet-like material from a roll, comprises two spaced apart arms, each including a cavity and an opening and an insert positioned in each of said cavities. Each of the inserts contains a pivotally mounted beveled plunger extending through an opening to form a pair of opposed beveled surfaces for receiving the roll. A coil spring urges the plungers through the openings.

2 Claims, 3 Drawing Figures

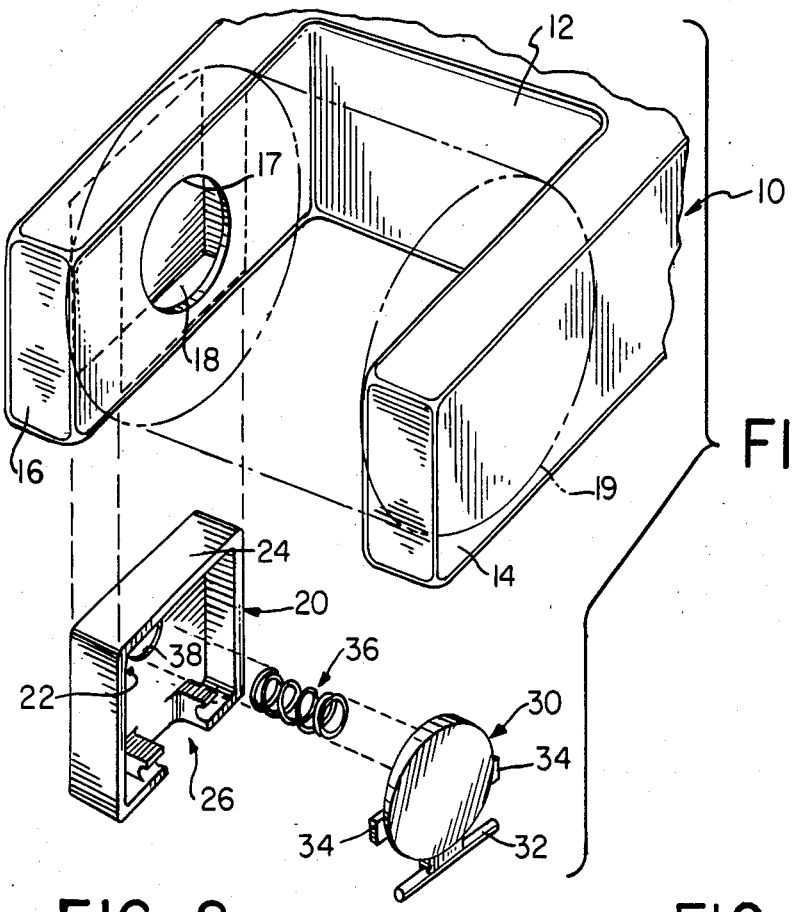
FIG. 1
FIG. 2
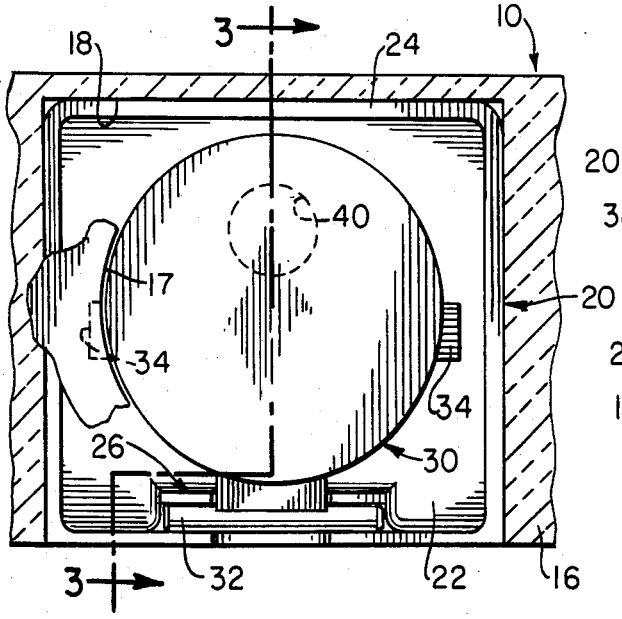
FIG. 3
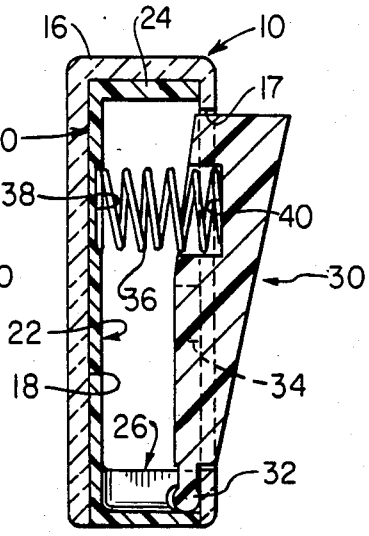

ROLL HOLDER

This invention relates to a device for holding a roll of paper or other material. More particularly, this invention relates to a roll holder for mounting toilet tissue, paper towels, plastic wrapping material or other types of sheet-like material commonly used in the home.

In practice, the replacement of a roll of toilet tissue is relatively cumbersome. Efforts have been made to provide toilet tissue holders which require little or no manual dexterity. For example, U.S. Pat. No. 3,878,998 of Lazzari discloses a roll holder which includes a pair of spring-loaded beveled plungers for receiving a roll of toilet tissue. This arrangement enables a user to replace a roll of paper using one hand by simply pushing the roll against the beveled plungers, thereby causing the plungers to retract until the roll is in place. The plungers are then returned by the springs into the center of the roll.

A somewhat similar construction is shown in Arronte U.S. Pat. No. 4,452,403 in which a pair of articulated end pieces may be forced aside by a roll of paper and then spring biased into the center of the roll.

The present invention is an improvement over the type of roll holder disclosed by Arronte and Lazzari in that it is specially adapted to be made of injection molded plastic and, therefore, provides a relatively inexpensive yet attractive product.

Although the roll holder of the invention is designed as a toilet tissue holder and is described herein as such, the principles of the invention are equally applicable to a device for holding rolls of any sheet-like material such as paper towels, waxpaper, plastic wrap, etc.

THE DRAWINGS

FIG. 1 is an exploded perspective view showing a roll holder in accordance with the invention;

FIG. 2 is a side view, partially in section, showing how the beveled plungers are supported; and FIG. 3 is a sectional view along the line 3—3 of FIG. 2.

DETAILED DESCRIPTION

Typically, a roll of toilet tissue, shown in phantom lines at 8, is supported in a U-shaped bracket 10 which includes a base 12 and opposing arms 14 and 16. Each of the arms 14 and 16 includes an opening 17 (only one of which is shown) which conforms generally to the shape of the hollow roll (not shown) on which the paper is mounted. In accordance with the preferred embodiment of the invention, each of the arms 14 and 16 include a cavity 18 adapted to receive a box-like insert 20.

Both inserts 20 are identical and, therefore, only one is described in detail. Each includes a flat base 22 encircled by a generally rectangular frame 24. A cradle 26 is formed at the bottom of the box-like insert 20 (as view in FIG. 1) for receiving a beveled plunger 30 which includes an axle 32 and projections 34. The plunger 30 is shaped so that it will extend through an opening 17 when the insert 20 is placed within cavity 18. The axle 32 rests within the cradle 26 and the projections 34 abut against the inerior surface of the associated arm 14 or 16 when the insert 20 is within cavity 18. The insert 20 also includes a coil spring 36 which is seated in a recess 38 in base 22 and an opposing recess 40 in the rear surface of plunger 30. Thus, the spring 36 biases the plunger 30 outwardly through the opening 17.

In accordance with the preferred embodiment, the bracket 10, insert 20 and plunger 30 can be injection molded of plastic. This reduces manufacturing cost and provides an attractive package. Moreover, the device is very easy to assemble after the parts have been manufactured. To do so, the plunger 30 is placed in the insert 20 with the axle 32 supported in cradle 26 and the coil spring 36 seated in recesses 38 and 40. The plunger 30 is then compressed against the force of spring 36 so that the insert 20 containing the mounted plunger can be pushed into the cavity 18. When the insert 20 is fully inserted within cavity 18, the plunger 30 will be opposite opening 17 and, since the diameter of the plunger 30 is smaller than that of opening 17, the spring 36 will force the plunger outwardly through the opening (see FIG. 3) where it is in position to receive the roll on which the paper 8 is supported. The outward movement of the plunger 30 is limited by abutment of projections 34 against the interior surface of the arm 14 or 16.

Because of the arrangement of the opposed beveled surfaces of the plungers 30, it is easy to insert a new roll 8 into the device. Thus, referring to FIG. 3, a new roll is inserted in an upward direction so that the beveled plungers 30 are pivoted in opposite directions by the force of the roll. When the roll is positioned coaxially with the openings 17, the springs 36 push the plungers 30 outwardly into the hollow center of the roll. The diameter of the plungers is less than that of the hollow center of the roll and, accordingly, the roll can rotate easily with respect to the plungers 30 to enable the paper to be dispensed in the usual fashion.

For commercial installations, a cover may be placed over the top of the paper roll. With the device configured as illustrated, this would prevent anyone from removing a full roll of paper since the cover would prevent lifting of the roll 8 and this, in turn, would mean that the roll could not be lifted high enough to clear the plungers 30. Since the roll cannot be removed by pulling downwardly, this would prevent unauthorized removal of the paper. After the paper has been used, there will be sufficient clearance to enable removal of the empty roll in the upward direction.

What is claimed is:

1. A holder for use in dispensing sheet-like material from a roll, comprising:

two spaced apart arms, each including a cavity and an opening, and an insert positioned in each of said cavities, each of said inserts supporting a beveled plunger extending through an opening to form a pair of opposed beveled surfaces for receiving said roll, each of such plungers including an axle and each of said inserts including an open cradle for pivotally retaining its associated axle, wherein each of said plungers further includes a projection adapted to abut against the interior surface of its associated arm to limit the outward movement of the plunger, and spring means for urging said plungers through said openings.

2. A holder according to claim 1 wherein each of said arms, insert and plunger comprises injection molded plastic.

* * * * *